US005901469A

United States Patent [19]

Saillet

[11] Patent Number: 5,901,469

[45] Date of Patent: May 11, 1999

[54] BOOT WITH A FLEXIBLE UPPER AND A REINFORCING FRAME THEREIN, PARTICULARLY FOR SNOWBOARDING

[75] Inventor: Benoit Saillet, Albens, France

[73] Assignee: Salomon S.A., Metz-Tessy, France

[21] Appl. No.: 08/913,358

[22] PCT Filed: Feb. 28, 1997

[86] PCT No.: PCT/FR97/00358

§ 371 Date: Sep. 16, 1997

§ 102(e) Date: Sep. 16, 1997

[87] PCT Pub. No.: WO97/32496

PCT Pub. Date: Sep. 12, 1997

[30] Foreign Application Priority Data

Mar. 6, 1996 [FR] France ..... 96/03007

[51] Int. Cl.[6] ..... A43B 5/00

[52] U.S. Cl. ..... 36/118.2; 36/115; 36/118.3; 36/119.1; 36/118.9

[58] Field of Search ..... 36/88, 89, 115, 36/117.1, 118.2, 118.3, 119.1, 118.9

[56] References Cited

U.S. PATENT DOCUMENTS

| | | | |
|---|---|---|---|
| 2,261,453 | 11/1941 | Reinhart et al. | 36/89 |
| 3,807,062 | 4/1974 | Spier | 36/117.1 |
| 4,869,001 | 9/1989 | Brown | 36/115 |
| 5,408,761 | 4/1995 | Gazzano | 36/88 |
| 5,722,187 | 3/1998 | Pamio et al. | 36/115 |

FOREIGN PATENT DOCUMENTS

| | | | |
|---|---|---|---|
| 0646334 | 4/1995 | European Pat. Off. . | |
| 2719197 | 11/1995 | France . | |
| 2722371 | 1/1996 | France . | |
| 2404233 | 4/1975 | Germany | 36/118.2 |
| 3622746 | 1/1998 | Germany . | |
| WO 95/09035 | 4/1995 | WIPO . | |
| WO 96/01575 | 1/1996 | WIPO . | |

*Primary Examiner*—M. D. Patterson
*Attorney, Agent, or Firm*—Greenblum & Bernstein P.L.C.

[57] ABSTRACT

A boot having a flexible upper for snowboarding. The boot includes a flexible upper portion and a rigid reinforcing frame, wherein the rigid reinforcing frame includes a lower reinforcement portion surrounding the heel at least; a dorsal reinforcement portion surrounding the rear area of the lower part of the leg; both parts are connected via a narrow connecting portion that includes, on the lateral side, a stiffening arrangement that stiffens the connecting portion only during lateral tilting of the dorsal reinforcement portion on the lateral side of the boot. Because of the aforementioned construction, the boot retains its qualities of comfort and, at the same time, ensures the transmission of the essential forces by virtue of a frame that provides flexibility on the medial side of the boot and support on the lateral side of the boot.

20 Claims, 6 Drawing Sheets

BOOT WITH A FLEXIBLE UPPER AND A REINFORCING FRAME THEREIN, PARTICULARLY FOR SNOWBOARDING

BACKGROUND OF THE INVENTION

1. Field of the Invention

The present invention is related to a boot with a flexible upper, especially intended for snowboarding.

2. Description of Background and Relevant Information

There are two broad categories of snowboarding boots: one has a rigid plastic shell equipped with a flexible inner liner, and the other has a flexible, or partially flexible upper, made of fabric, leather or flexible plastic. The first category is not really adapted to the modern practice of snowboarding because the practitioners are often required to move while walking on snow. The invention is related to the second category of flexible boots that is better adapted to walking. These days, these shoes or boots are essentially designed as simple, lengthy boots, that are impervious and comfortable but devoid of any effective role in the transmission of forces that is associated with the dynamic practice of the discipline. In the majority of cases, these boots are adapted to so-called "shell" bindings that comprise a base on which the sole and a dorsal element linked to the base rest, and that provides a rigid rear support to the lower part of the leg, especially when the snowboarder makes back side turns. Straps in sufficient numbers ensure the tightening of the boot in the binding.

These systems have disadvantages. They are cumbersome because of the rear ascending element and because of the presence of the straps. The straps must be readjusted each time that the boot is reengaged into the "shell" binding, before each descent. The tightening of the straps must be adequate in order to retain the boot efficiently; this causes problems of comfort due to the flexibility of the upper. Finally, these shells transmit the various combined bending forces badly because the adaptation of their shapes is often approximate, this being especially true for the dorsal element with the boot, and this is not adequately rectified by tightening the straps.

Various binding systems, called "step-in" systems evolved in order to replace the shell bindings, and these consist of connecting one or several gripping elements linked to the sole of a flexible boot to an automatic latching system affixed on the board. Such an example of a "step-in" binding is described in the application WO 95/09035. For the transmission of forces, the flexible boot is subject to a localized reinforcement, especially in order to ensure rear support.

The document FR 2 722 371 is related to this type of boot that comprises a flexible and deformable inner liner portion, an impermeable and flexible outer upper portion and, located between these two portions, a more rigid shell element on which is journalled, along an axis passing through the median longitudinal plane of the boot, a journalled dorsal element that encloses a portion of the calf. This type of boot has the advantage of being more efficient when the snowboarder makes back side turns due to the fact that the dorsal element is inserted into the structure of the boot, while also promoting a certain lateral looseness, either on the inner or outer side, so as to allow the snowboarder to adopt leg positions that are more or less bent laterally with respect to his torso.

The document EP-A1-646334 is also related to a boot with an inner frame having a journalled dorsal part. In the example described, the boot is connected to a base in the form of a plate and the tightening on this base is done by straps. This solution thus picks up on some of the disadvantages of strap bindings.

The patent application FR 2 719 197 suggests another solution consisting of a boot with a flexible upper and a rigid, journalled, outer frame. The principle of construction for such a boot enables it to be adapted onto any type of binding, including traditional board bindings for lengthy, rigid shell boots that are derived from downhill skiing.

All these solutions for boots are interesting because they offer a rear support in "back side" turns, as well as internal, lateral flexibility for figures, jumps, etc. However, when the snowboarder is in the position of relaunching his board, or in the skating phase, he requires a certain external lateral support. This asymmetry in the external/internal (i.e., lateral/medial) functions is not dealt with in the known prior art solutions.

SUMMARY OF THE INVENTION

It is an object of the instant invention to provide a satisfactory solution for the above-cited problem. The invention is related, in particular, to a boot of the flexible type that retains its qualities of comfort while at the same time ensuring the transmission of essential forces required for the good control and mastery of the board in every condition of use.

To achieve this objective, the invention is related to a boot, especially intended for the practice of snowboarding, comprising a flexible upper portion and a rigid reinforcing frame. This rigid reinforcing frame comprises a lower reinforcement portion, at least surrounding the heel, and a dorsal reinforcement portion surrounding the rear area of the lower part of the leg. Both these portions are connected by a narrow connecting portion comprising, on the lateral or external side, a stiffening means that stiffens said portion only during the lateral tilting of said upper reinforcement portion on the external side of the boot. Thus, the internal/external (i.e., medial/lateral) looseness is dealt with in an asymmetrical manner, whilst ensuring minimal reinforcement.

According to another characteristic of the invention, the stiffening means is constituted of several adjacent abutment elements that come into contact with one another during the lateral tilting of the dorsal reinforcement portion on the external side of the boot. This construction allows for a certain controlled deformation on the external side of the boot, and for unimpeded deformation on the inner side of the boot. Because of the constructional simplicity of the invention, the frame can be made all in one piece from molded plastic.

The frame can be integrated into the structure of the boot itself, as well as be external with respect to the upper of the boot. The wear sole of the boot can also constitute an integral part of such frame.

BRIEF DESCRIPTION OF THE DRAWINGS

Other characteristics and advantages of the invention will become apparent from the description that follows, with reference to the annexed drawings that illustrate, as non-limiting examples, some possible embodiments of the invention.

DETAILED DESCRIPTION OF THE PREFERRED EMBODIMENTS

Figure 1:
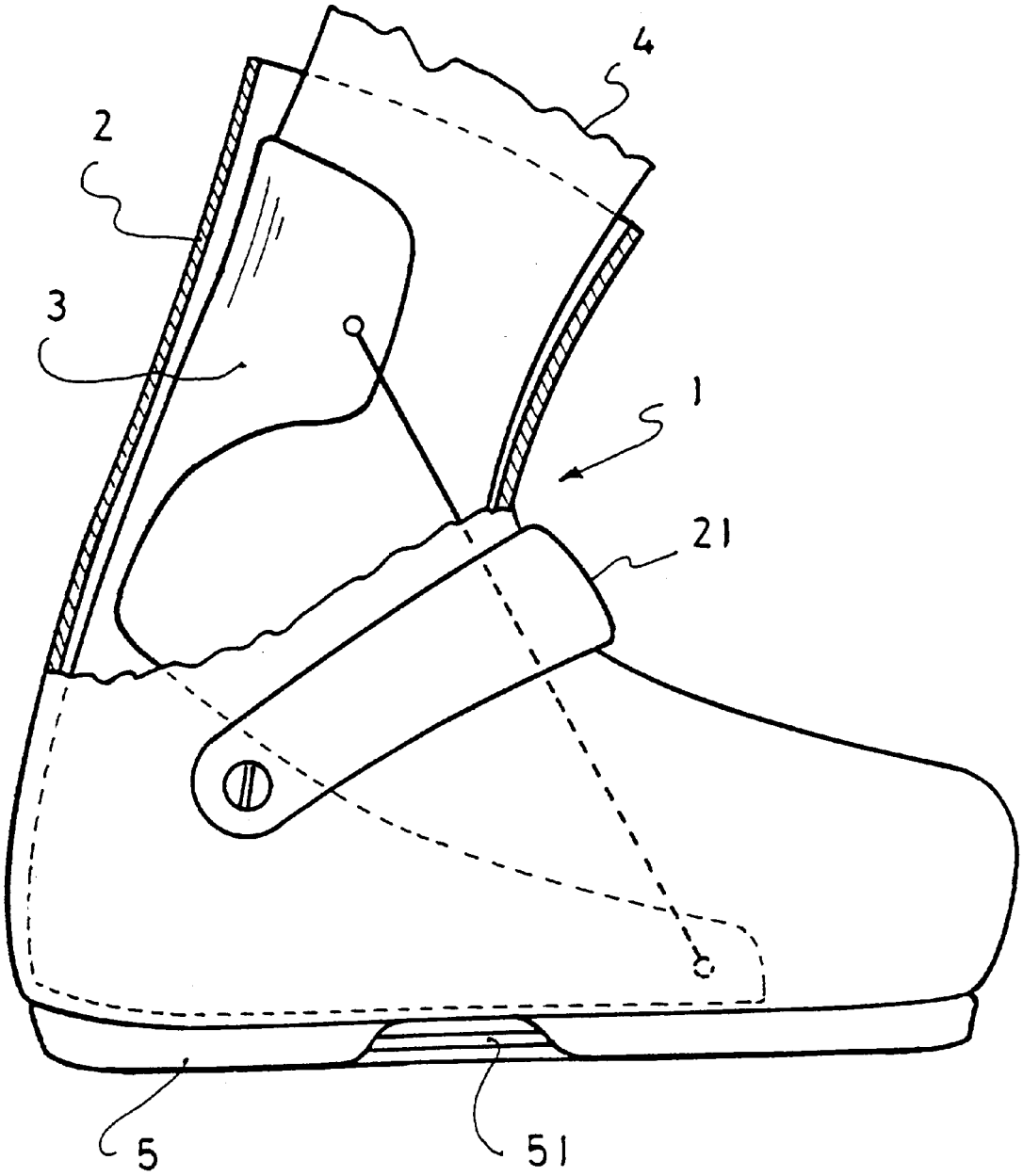
FIG. 1 illustrates a boot as per the invention in a side view.

FIG. 1 shows a first embodiment of a boot 1 of the flexible type as per the invention. It has, in a known manner, a flexible upper 2 and an outer sole 5, adapted to walking, and made from a wear-resistant material such as rubber, for example. The upper 2 is connected to the outer sole 5 by any means known to a person of the art, such as by adhesive, welding, riveting or any other means. The sole can comprise an anchoring member 51, such as a buckle for example, as represented in FIG. 1, that is adapted to cooperate with a complementary latching member (not represented) that is affixed to the glide board in order to together form a retention device for a boot of the "step-in" type, for example.

The flexible upper 2 can be formed of different parts from various flexible materials and be connected together via different means (stitching, riveting, adhesive etc.). In a conventional manner, the upper can, for example, also have an overlapping tongue and a lacing, that have not been represented. One or several straps complete the tightening of the upper, like an instep strap 21, for example.

Within this upper that forms the external portion of the boot, an inner liner 4 is inserted, such liner being capable of rising more or less high and exceeding the upper for greater comfort. It is made of a flexible and deformable material, completely of foam, for example, or it can comprise an envelope made of a textile material or leather and be filled with a flexible foam.

According to the invention, the boot comprises a reinforcing frame 3 between the inner liner 4 and the rest of the boot. In the example illustrated, the rest of the boot represents the external upper 2 and the sole 5 that is attached to it, together forming an external portion of the boot. However, this constructional embodiment is not limiting in itself, and one can envision other similar types of constructions.

Figure 2:
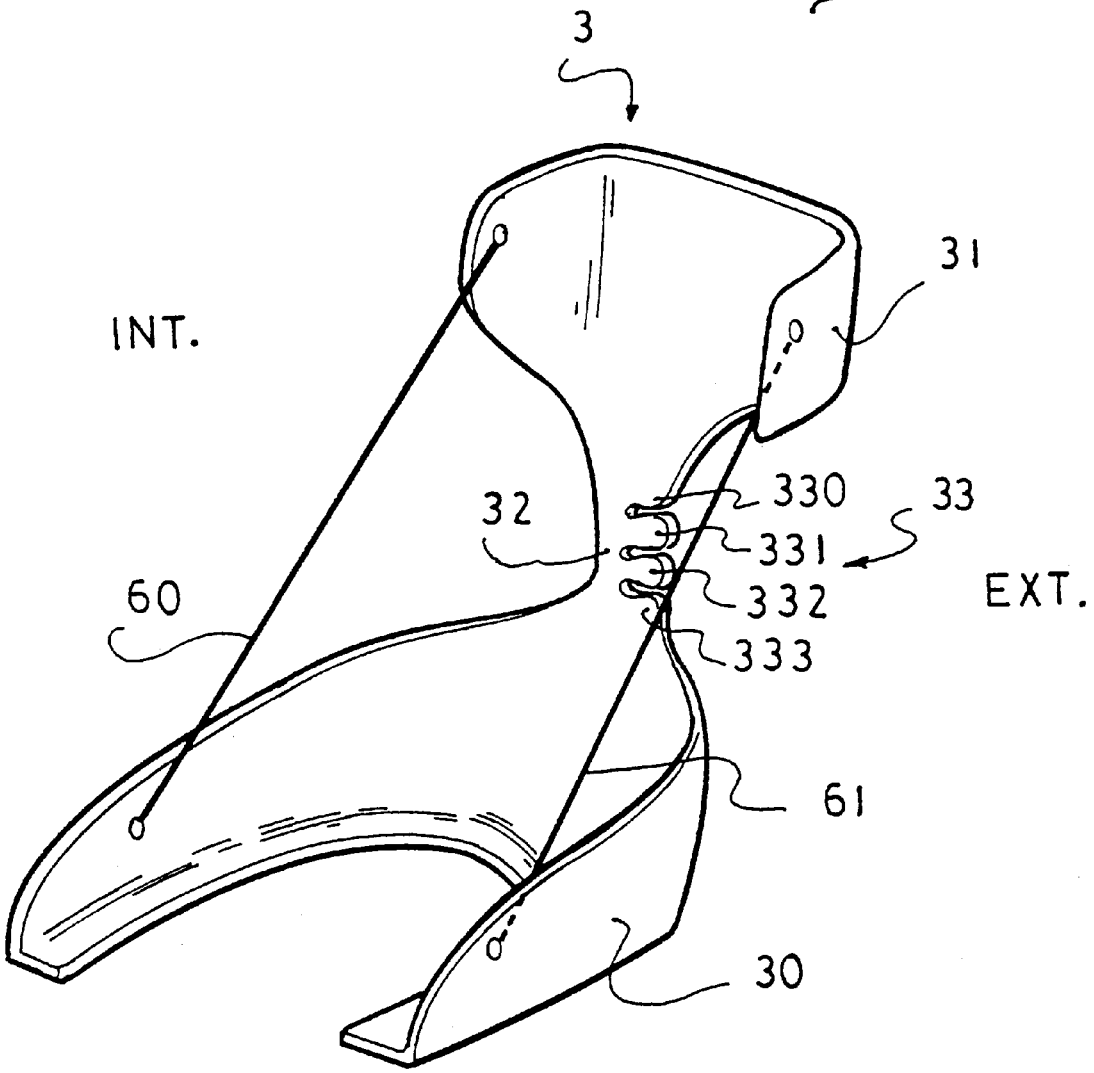
FIG. 2 shows the inner frame of the boot of FIG. 1.

As is shown more specifically in FIG. 2, the rigid reinforcing frame 3 alone comprises a lower reinforcement portion 30 that surrounds the heel at least, and a dorsal reinforcement portion 31 that surrounds the rear area of the lower part of the leg; both the portions 30, 31 are linked by a narrow connecting portion 32 that comprises, on the external side (EXT), a stiffening means 33 that stiffens said portion 32 only during the lateral tilting of said upper reinforcement portion 31 on the external (EXT) side of the boot.

The stiffening means 33 comprises a structure which, in the illustrated embodiment is constituted of several adjacent abutment or rigidifying elements 330, 331, 332, 333 that come into contact with one another during the lateral tilting of the dorsal reinforcement portion 31 on the external (EXT) side of the boot. The abutment elements extend transversely and are separated by lateral extending openings or cut-outs 430, 431, 432. The two central elements 331, 332 thus have the shape of fingers that are demarcated on either vertical side by a cut-out, and they are connected on the internal (i.e., medial) side. The elements 330, 333 respectively form a part of the edge of the dorsal portion 31 and the edge of the lower reinforcement element 30. In order to ensure solid rear support, especially while making "back-side" turns, the frame 3 comprises two lateral opposing bracings 60, 61, each connecting one side of the dorsal reinforcement portion 31 to one side of the lower reinforcement portion 30.

Figure 3:
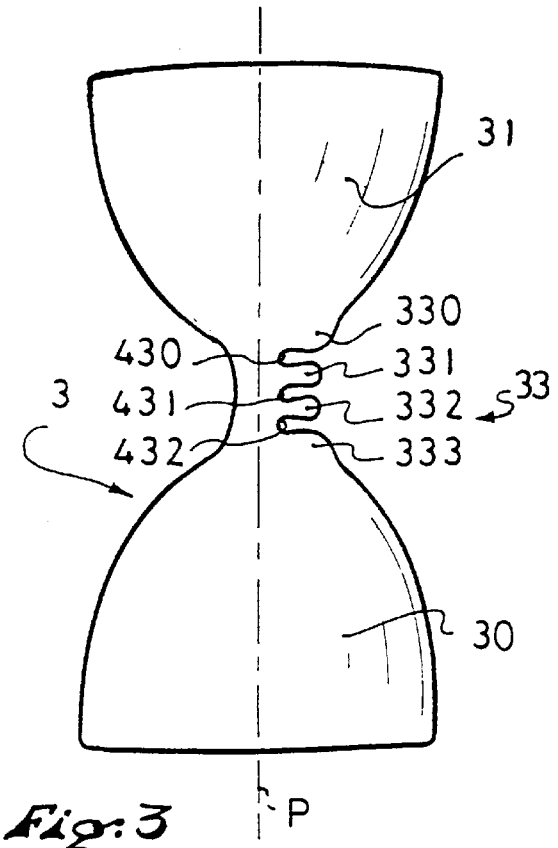
FIG. 3 is a rear view of the frame of FIG. 2 in a resting position.
Figure 4:
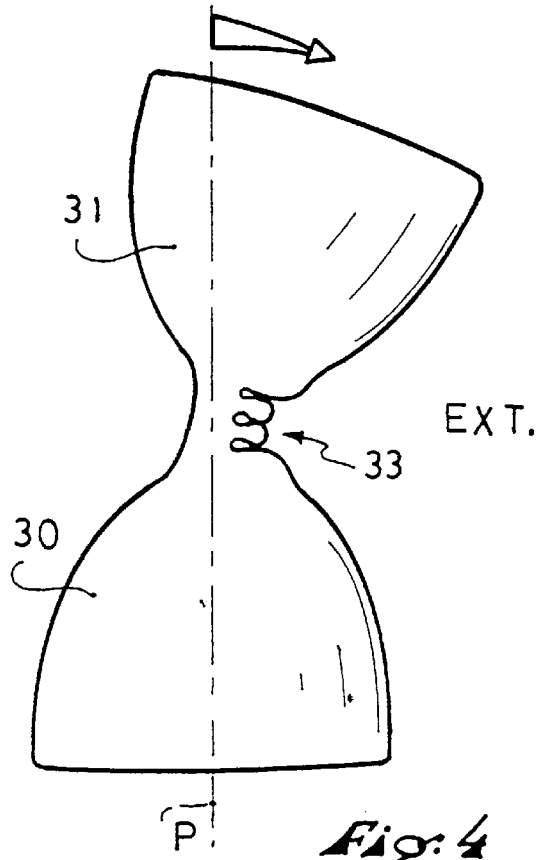
FIG. 4 is a rear view of the frame of FIG. 2 in which the external side is in a bent position.
Figure 5:
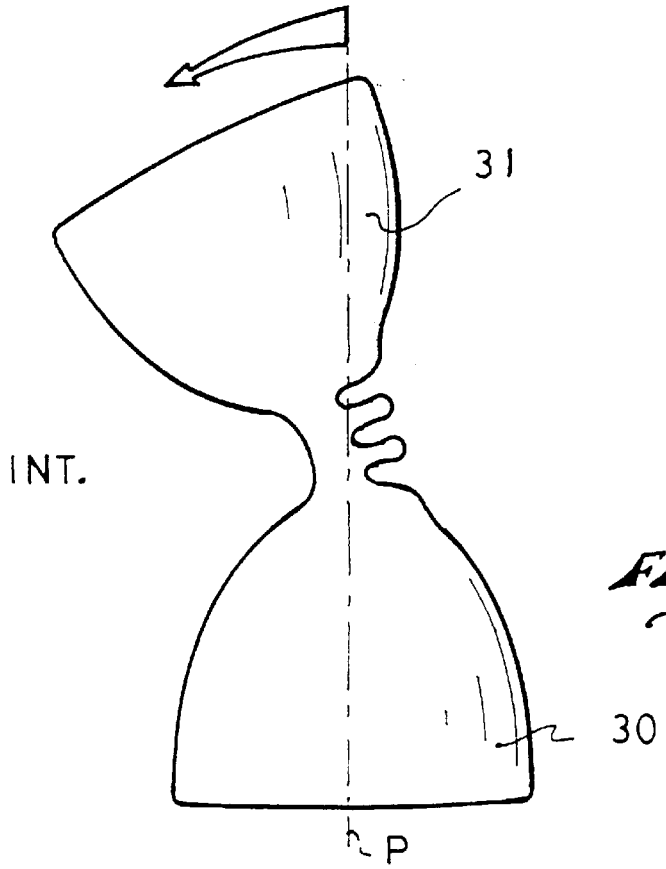
FIG. 5 is a rear view of the frame of FIG. 2 in which the internal side is in a bent position.

The operating principle is illustrated more specifically in FIGS. 3, 4 and 5.

In FIG. 3, the frame is in the upright position; the dorsal portion 31 is aligned with respect to the median vertical plane P.

During a tilting on the external (or lateral) side (EXT) of the lower part of the leg, the dorsal portion is pulled along and is inclined until the abutment elements 330, 331, 332, 334 come into contact. Thus, the inclination can be limited to a specific value in order to favor external support during the relaunching phase, for example, as can be seen from FIG. 4.

Inversely, during a tilting on the internal or medial side (INT) of the lower part of the leg, as illustrated in FIG. 5, the narrow portion can bend freely without any hard points or specific stiffness.

Figure 6:
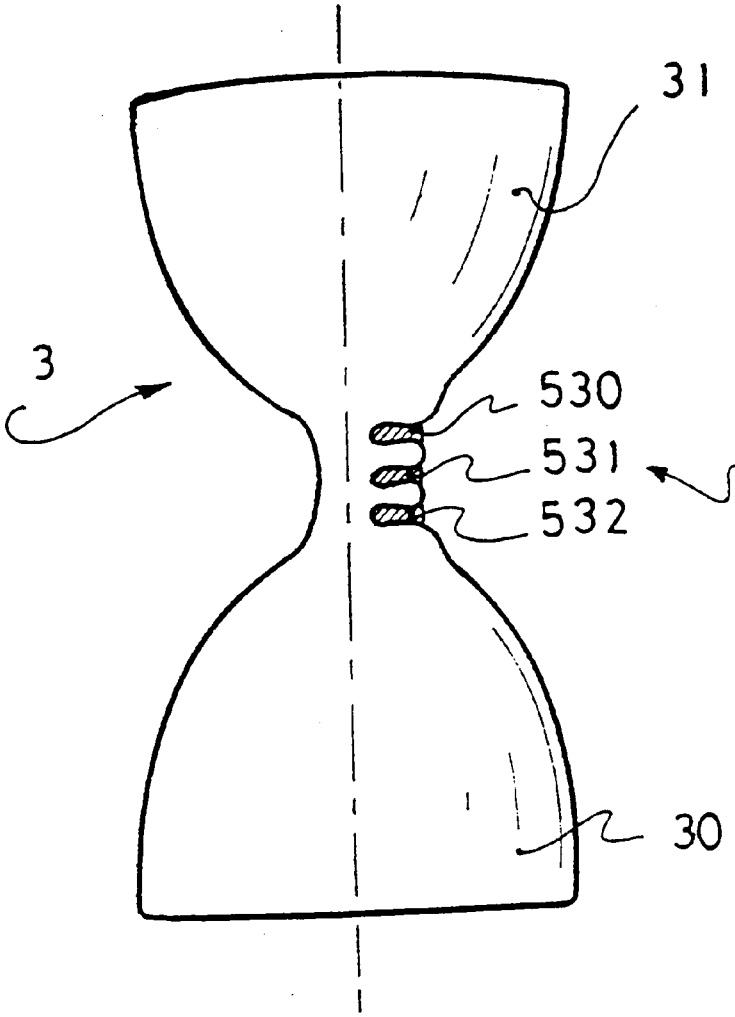
FIG. 6 is a rear view similar to that of FIG. 3 as per a variation.

According to a possible variation, the abutment elements 330, 331, 332, 333 are separated by flexible and elastically compressible elements 530, 531, 532, as is shown in FIG. 6. Thus, one is able to obtain greater progressiveness in external support. These flexible elements can be constituted of elastomer or soft plastic pads, for example. Depending on the characteristics of the material, energy restitution is given preference if the material is highly elastic (High Elasticity Modulus), or shock absorption is given preference, if the material is selected from among visco-elastic or visco-plastic materials having a shock absorption coefficient on the order of 0.2 to 1.5 (Beta coefficient) and a Shore Hardness A of 5 to 90, for example.

Figure 7:
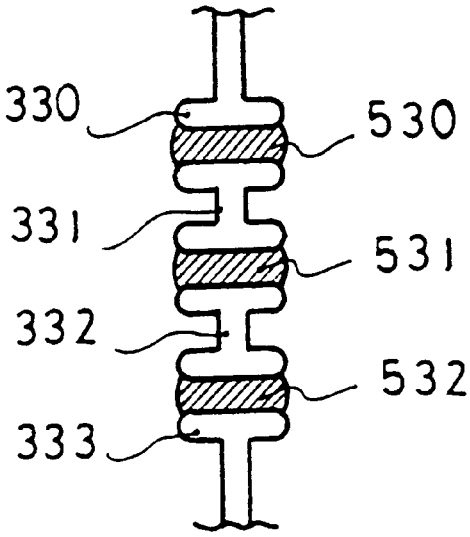
FIG. 7 illustrates a detail of FIG. 6.

FIG. 7 shows that the abutment elements 330, 331, 332, 333 have an enlarged contact base so as to ensure a contact, or incidentally, a compression of the pads as in this specific example, even in the case of combined front/external bending, for example, or in case the frame is twisted due to the rotation of the ankle.

Figure 8:
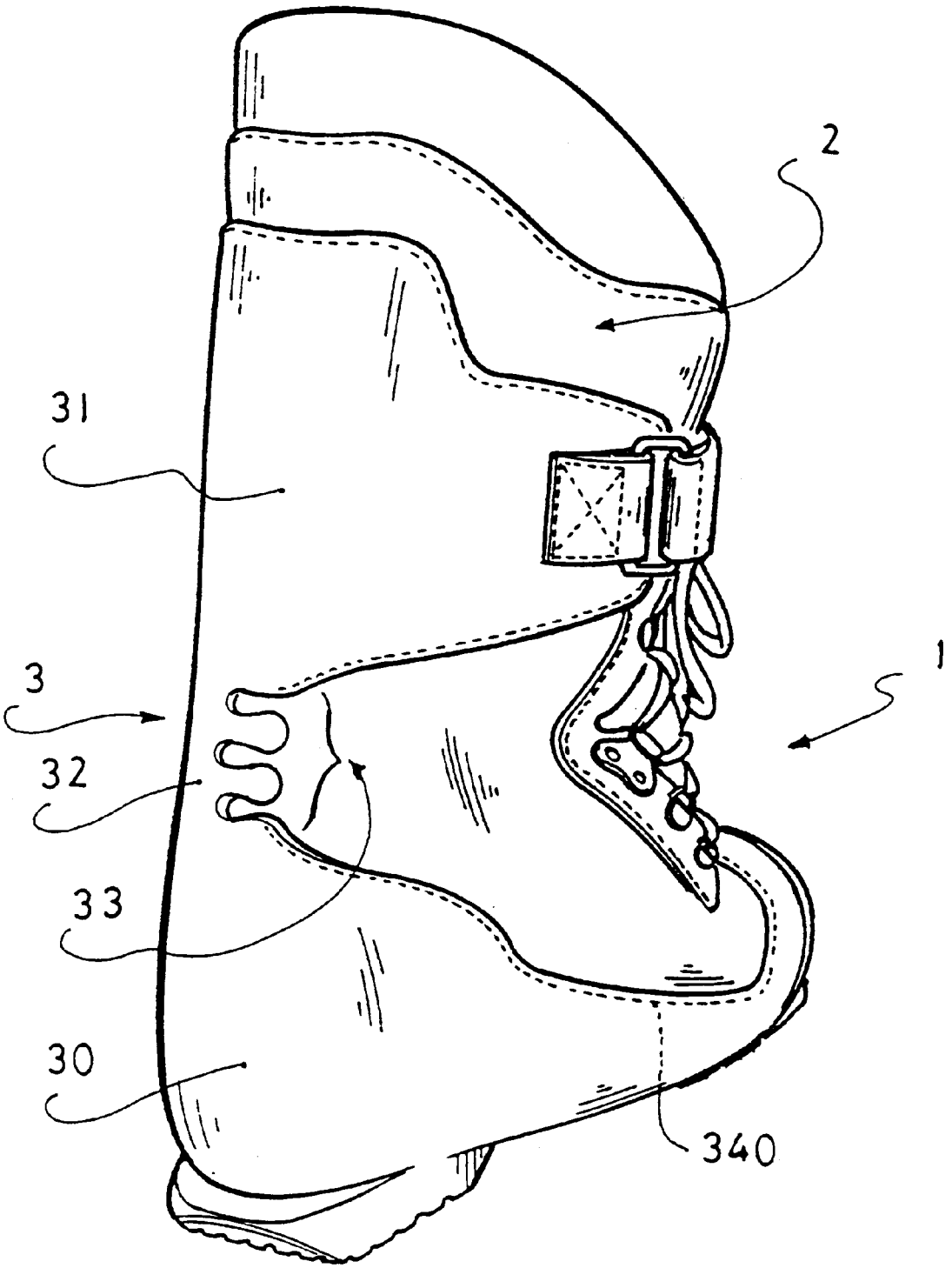
FIG. 8 shows a boot with an external frame as per another possible variation of the invention.

FIG. 8 shows another embodiment of the invention wherein the frame 3 is arranged outside the boot and partially covers the flexible upper portion 2. In this case, the lower reinforcement element 30 is extended frontwardly to form the lower shell portion 34 and downwardly, to form the walking sole 5 of the boot. The lower shell portion is a reinforcement portion that borders each lateral side of the boot and that extends to the front end, into the toe region. The flexible upper 2 is connected to the edge of this portion by any appropriate means such as adhesive, welding, riveting, stitching or a combination of such means. The dotted line 340 represents an assembly by stitching, as an example.

Figure 9:
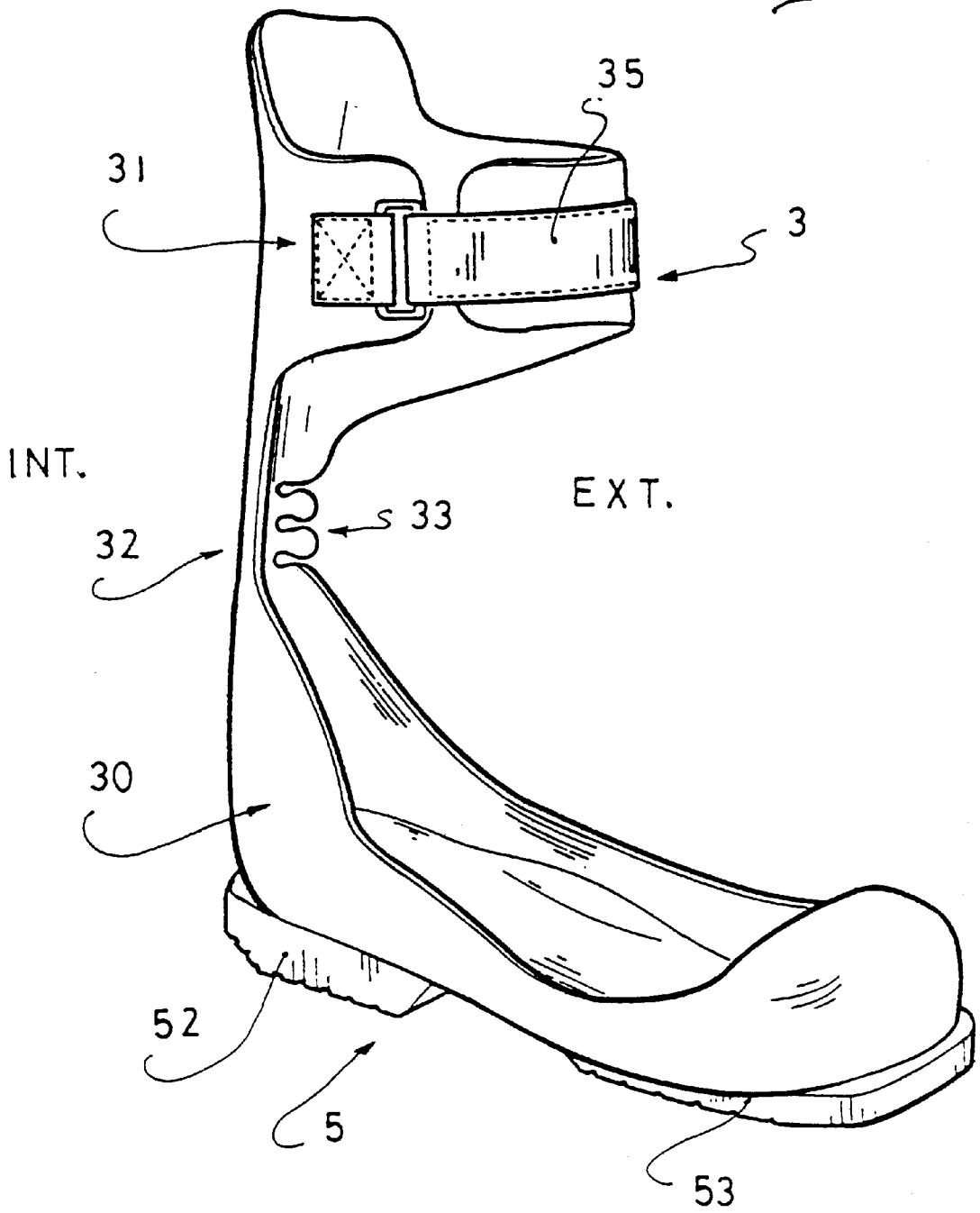
FIG. 9 is a view of the frame of FIG. 8.

FIG. 9 shows the frame 3 by itself. As in all the previous examples, frame 3 is preferably constituted all in one piece, i.e., unitary, from a molded plastic material. The sole elements 52, 53 can also be attached and affixed onto the frame. The presence of a tightening means for the lower part of the leg, such as a strap 35 mounted on the dorsal portion 31, ensures an accompaniment of the frame during the front and/or inner bending. Naturally, length adjustment means can be associated to the strap 35. In this example, the dorsal portion almost entirely surrounds the lower part of the leg.

Generally speaking, the frame is made from a rigid plastic material. Among the plastic materials that are considered suitable, one can cite the use of polyurethanes, polyamides, ABS, polypropylenes etc. The thickness of the frame can be of the order of 1 to 8 mm, for example.

Naturally, the invention is not limited to the embodiments described as non-limiting examples, but also includes all technical equivalents enabling, for example, an asymmetrical internal/external stiffness to be obtained.

The flexible elements 530, 531, 532 that separate the abutment elements 330, 331, 332, 333 can be designed to be injected into a mold during a second injection step, whereas the first injection step would consist of earlier injecting the reinforcing frame 3 into the mold.

In the same spirit, by using the technique that consists of successively injecting different plastic materials into the same mold, one can vary the internal and external stiffness by selecting the materials appropriately and defining the shapes of the flexible element or elements. The elements are obtained all in one piece and are made by using at least two different materials.

I claim:

1. A boot comprising:

a rigid reinforcing frame, said reinforcing frame including:

a lower reinforcement portion at least for surrounding the heel of the wearer of the boot;

a dorsal reinforcement portion for surrounding the rear of the lower part of the leg of the wearer of the boot; and a relatively narrow connecting portion facilitating lateral tilting of said dorsal reinforcement portion on internal and external sides of the boot, said connecting portion having an external side, said connecting portion including, on said external side, means for stiffening said connecting portion only upon lateral tilting of said dorsal reinforcement portion on said external side of the boot.

2. A boot according to claim 1, wherein:

the boot is a snowboarding boot.

3. A boot according to claim 1, wherein:

said lower reinforcement portion and said dorsal reinforcement portion are made in one piece.

4. A boot according to claim 3, wherein:

said lower reinforcement portion and said dorsal reinforcement portion are made of molded plastic.

5. A boot according to claim 1, wherein:

said rigid reinforcement frame is constituted all in one piece from molded plastic.

6. A boot according to claim 1, wherein:

said means for stiffening, on said external side of said connecting portion, comprises a plurality of adjacent laterally extending abutment elements having abutment surfaces, respective ones of said abutment surfaces of said abutment elements being in contact upon said lateral tilting of said dorsal reinforcement portion.

7. A boot according to claim 6, wherein:

in an upright position of said reinforcing frame, said abutment surfaces are vertically spaced apart by laterally extending openings.

8. A boot according to claim 1, wherein:

said means for stiffening, on said external side of said connecting portion, comprises a plurality of adjacent laterally extending abutment elements having abutment surfaces, respective ones of said abutment surfaces of said abutment elements being movable toward each other upon said lateral tilting of said dorsal reinforcement portion; and in an upright position of said reinforcing frame, said abutment elements are separated by elements made of elastically compressible material.

9. A boot according to claim 1, further comprising:

an external walking sole;

a flexible upper portion extending upwardly from said external sole; and an inner liner within said flexible upper;

wherein said rigid reinforcing frame is positioned between said inner liner and said flexible upper portion.

10. A boot according to claim 9, further comprising:

two opposing lateral bracings, each of said bracings extending from a respective side of said dorsal reinforcment portion to a respective side of said lower reinforcement portion.

11. A boot according to claim 1, further comprising:

an external walking sole;

a flexible upper portion extending upwardly from said external sole; and wherein said rigid reinforcing frame is positioned outside of said flexible upper portion.

12. A boot according to claim 1, further comprising:

a flexible upper portion;

wherein said rigid reinforcing frame partially covers said flexible upper portion.

13. A boot according to claim 1, wherein:

said lower reinforcement portion extends forwardly to form a lower rigid shell of the boot and downwardly to form an external walking sole of the boot.

14. A snowboarding boot comprising:

a rigid reinforcing frame, said reinforcing frame including:

a lower reinforcement portion at least for surrounding the heel of the wearer of the boot;

a dorsal reinforcement portion for surrounding the rear of the lower part of the leg of the wearer of the boot; and a connecting portion facilitating lateral flexing of said dorsal reinforcement portion medially and laterally;

said connecting portion comprising a plurality of laterally extending, vertically separated rigidifying elements;

said connecting portion having a lateral side and a medial side, said plurality of rigidifying elements being connected to each other on said medial side.

15. A snowboarding boot according to claim 14, wherein:

said rigid reinforcement frame is constituted all in one piece from molded plastic.

16. A snowboarding boot according to claim 14, wherein:

said rigidifying elements include spaced apart surfaces, respective ones of said surfaces of said rigidifying elements being in contact upon said lateral flexing of said dorsal reinforcement portion.

17. A snowboarding boot according to claim 16, wherein:

in an upright position of said reinforcing frame, said surfaces are vertically spaced apart by laterally extending openings.

18. A snowboarding boot according to claim 16, wherein:

in an upright position of said reinforcing frame, said elements are separated by elements made of elastically compressible material.

19. A snowboarding boot according to claim 14, further comprising:

an external walking sole;

a flexible upper portion extending upwardly from said external sole; and an inner liner within said flexible upper;

wherein said rigid reinforcing frame is positioned between said inner liner and said flexible upper portion.

20. A snowboarding boot according to claim 14, further comprising:

an external walking sole;

a flexible upper portion extending upwardly from said external sole; and wherein said rigid reinforcing frame is positioned outside of said flexible upper portion.

* * * * *